US005580218A

United States Patent [19]

Nguyen et al.

[11] Patent Number: 5,580,218

[45] Date of Patent: Dec. 3, 1996

[54] BLADED ROTOR

[75] Inventors: Uy-Liem Nguyen, Dättwil; Ueli Wieland, Wettingen, both of Switzerland

[73] Assignee: ABB Management AG, Baden, Switzerland

[21] Appl. No.: 511,438

[22] Filed: Aug. 4, 1995

[30] Foreign Application Priority Data

Oct. 14, 1994 [DE] Germany ..... 44 36 729.5

[51] Int. Cl.[6] ..... F01D 5/30

[52] U.S. Cl. ..... 416/215; 416/219 R

[58] Field of Search ..... 416/215, 216, 416/217, 218, 219 R, 222

[56] References Cited

U.S. PATENT DOCUMENTS 2,414,278 1/1947 Soderberg ..... 416/217

5,474,423 12/1995 Seeley et al. ..... 416/219 R

FOREIGN PATENT DOCUMENTS

0478234A1 4/1992 European Pat. Off. .

61-212603 9/1986 Japan ..... 416/219 R

*Primary Examiner*—James Larson

*Attorney, Agent, or Firm*—Oblon, Spivak, McClelland, Maier & Neustadt, P.C.

[57] ABSTRACT

In a bladed rotor of an axial-flow turbomachine, the blades essentially consist of a blade body and a blade root. They are fastened with their blade roots in rows in encircling blade grooves having lateral supporting prongs. A shoulder serving to assemble the blades on the rotor is attached between blade body and blade root. The blade grooves are shaped symmetrically to the associated planes of symmetry by a plurality of radii (R1–R4), the preceding radius (R1) in each case being larger than the following radius (R2). The circular arcs formed by the radii (R1–R4) have a common tangent (T) at their contact points.

3 Claims, 2 Drawing Sheets

FIG. 1
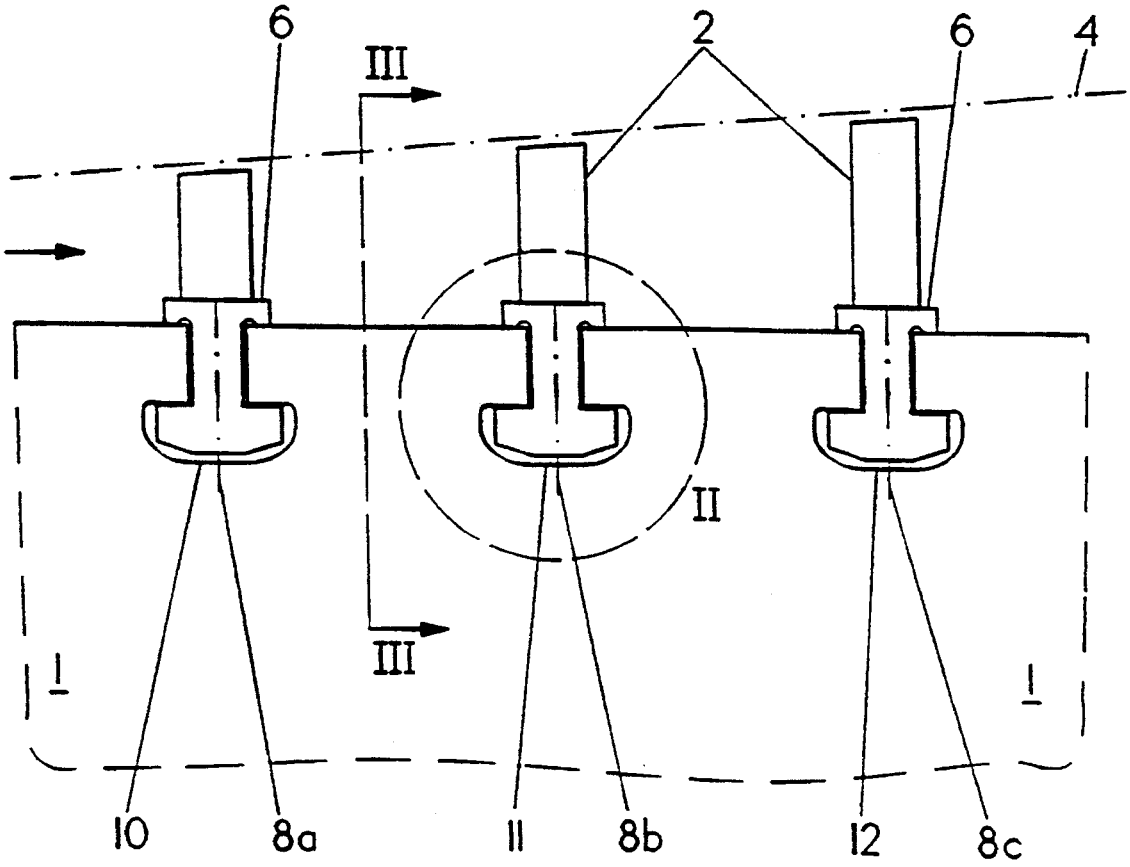
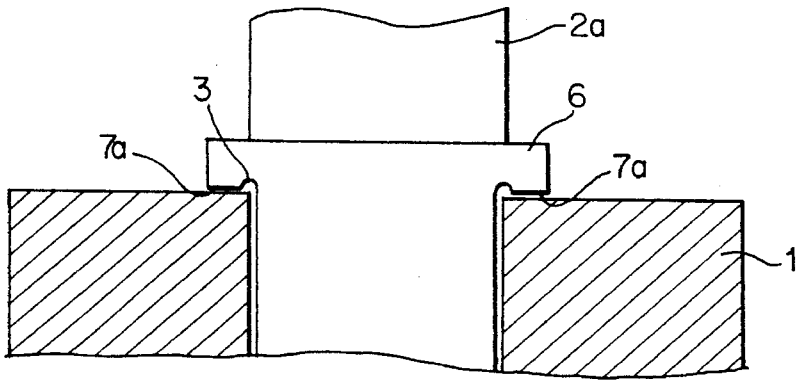
FIG. 2a

BLADED ROTOR

BACKGROUND OF THE INVENTION

1. Field of the Invention

The invention relates to a bladed rotor of an axial-flow turbomachine, in which the blades, essentially consisting of a blade body and a blade root, are fastened with their blade roots in rows in encircling blade grooves having lateral supporting prongs.

2. Discussion of Background

Bladed rotors of this type are known. The blades are turned with their roots into the encircling grooves. This is made possible by the rectangular horizontal projection of the blade root. The blades can be inserted into the groove in a manner turned through ninety degrees. The blades are turned into their correct position in the groove. This is also usually done by hammering in the area between blade body and blade root, which, however, can lead to damage of the blade. So that the blades can be inserted into the groove, the blade roots and the grooves are produced with clearance.

Therefore metal strips are normally pushed between the blade root and the groove root after the blades are inserted. The clearance is thereby compensated for and the blades are fixed in their correct position. However, the groove root can be damaged when the shims are being inserted. In addition, the groove root of the encircling groove is established by the shims and cannot be changed.

SUMMARY OF THE INVENTION

Accordingly, one object of the invention is to provide a novel bladed rotor of the type mentioned at the beginning, and to fit the blades into the rotor without damaging the groove root (or groove bottom) and the blades and to optimally configure the grooves.

According to the invention this is achieved when a shoulder serving to assemble the blades on the rotor is attached between the blade body and blade root, and when the blade grooves are shaped symmetrically to the associated planes of symmetry by a plurality of radii, the preceding radius in each case being larger than the following radius, and the circular arcs formed by the radii having a common tangent at their contact points.

The advantages of the invention can be seen, inter alia, in the fact that shims between groove root and blade root are no longer required. The groove root of the encircling grooves therefore becomes freely formable. The stress distributions in the grooves can therefore be optimized by means of the finite element method. Upon assembly of the blades, the shoulder additionally serves to protect the blade from damage.

It is especially convenient if shims are pushed between rotor and shoulder to fix the blades.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a partial longitudinal section of a bladed rotor;

FIG. 2*a* is a partial view of the blade and rotor showing an alternate embodiment with shims.

Figure 2:
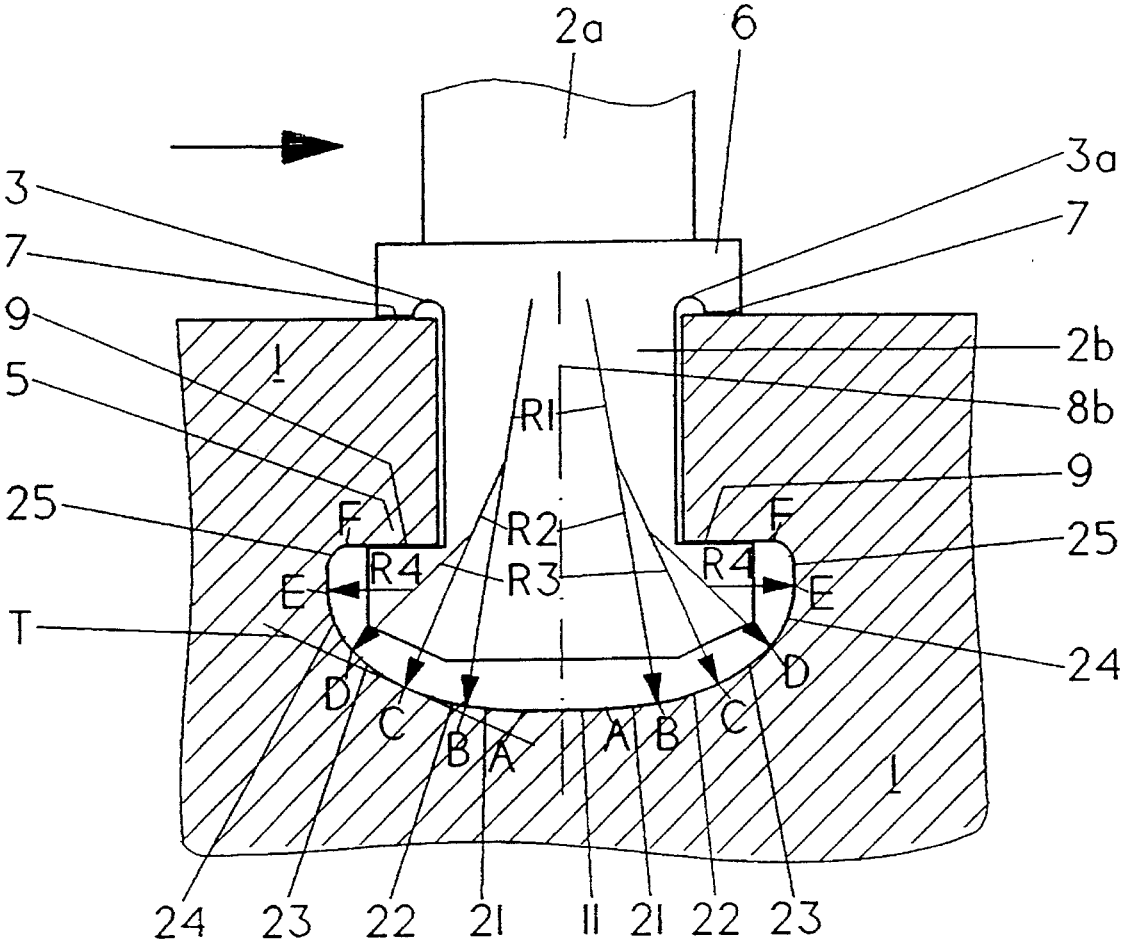
FIG. 2 shows an enlarged detail II from FIG. 1.

Only the elements essential for understanding the invention are shown. Elements of the plant not shown are, for example, all non-rotating parts. The direction of flow of the working medium is designated by an arrow.

DESCRIPTION OF THE PREFERRED EMBODIMENTS

Referring now to the drawings, wherein like reference numerals designate identical or corresponding parts throughout the several views, FIG. 1 shows three moving rows of a high-pressure rotor 1. The individual blades 2, essentially consisting of blade body 2*a*, blade root 2*b* and shoulder 6, are inserted in encircling blade grooves 10, 11 and 12. In this arrangement, the blade groove 10 lies on the steam-inlet side, and the blade groove 12 lies on the steam-outlet side. The flow-limiting contour 4 of the cylinder (not shown) is indicated by chain-dotted lines.

Figure 3:
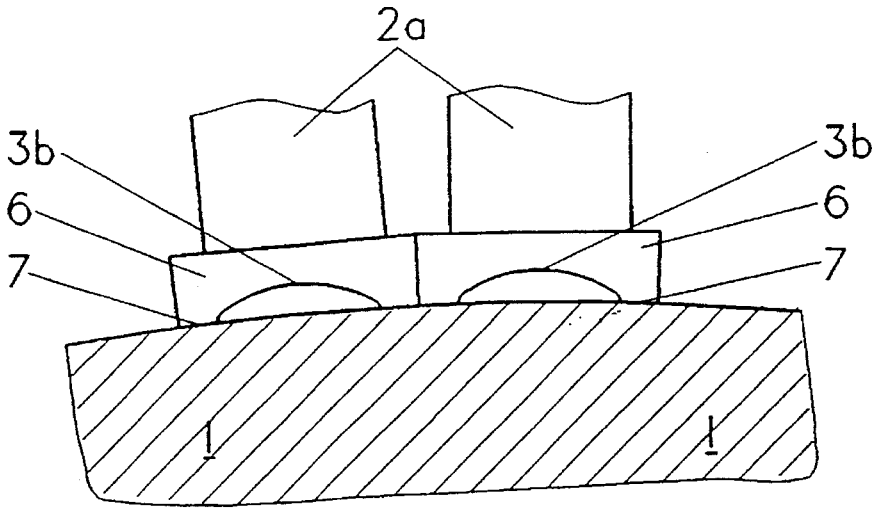
FIG. 3 shows a partial transverse section through the rotor along line III—III in FIG. 1.

FIG. 2 shows the hammer-head shape of the blade root 2*b* in detail. The forces occurring during operation are passed into the rotor 1 via supporting prongs 5 of the blade groove 11. Consequently, supporting surfaces 9 form between blade root 2*b* and blade groove 11. The shoulder 6 is arranged between blade root 2*b* and blade body 2*a*. The shoulder 6 is essentially configured in the shape of a parallelepiped. According to FIG. 2 and FIG. 3, niches 3*a* and 3*b* are located in the side of the shoulder 6 facing the rotor 1. Bearing surfaces 7 are formed by these niches 3*a* and 3*b*, via which bearing surfaces 7 the blades 2 are supported on the rotor 1 upon assembly. A distance X between the bearing surface 7 and the supporting surface 9 is selected in such a way that during production negative tolerances are provided for the blade groove 11 and positive tolerances are provided for the blade 2. This results in a clearance necessary for the assembly of the blades 2. If necessary this clearance must be compensated for by shims 7(*a*) (FIG. 2*a*) which are placed under the bearing surface 7 between rotor 1 and shoulder 6. Relative to the respectively associated plane 8*a*, 8*b* and 8*c* of symmetry, the steam-inlet-side contours of the blade grooves 10, 11 and 12 are in mirror symmetry to the steam-outlet-side contour. Therefore only the steam-inlet-side contour will be described below. The planes 8*a*, 8*b* and 8*c* of symmetry lie perpendicularly to the rotor and in the center of the associated blade groove 10, 11 or 12. The form of the blade groove 11 is described by a plurality of radii R1, R2, R3 and R4 following one another. The radius R1 is greater than R2, R2 is greater than R3, and R3 is greater than R4. Points A, B, C, D and E are defined on the contour of the part of the blade groove 11 which is described by the radii R1 to R4. These points subdivide the contour into circular arcs 21, 22, 23 and 24 described by the radii R1 to R4. Here, circular arc 21 goes from point A to point B, circular arc 22 goes from point B to point C, and so on. The points A–E are each locations of common tangents of the sectional curves touching there. Thus a straight line T through the point C is a tangent of the circular arc 22 described by the radius R2, then the straight line T is also a tangent of the circular arc 23 described by the radius R3. It follows from this that the centers of the circular arcs 22 and 23 lie on a perpendicular to the tangent T through the point C. This correspondingly applies to the centers of the further circular arcs. From point E, the groove is described by a curve 25 of essentially any form. The further blade grooves 10, 12 of the rotor 1 are of identical configuration to the blade groove 11.

The invention is of course not restricted to the exemplary embodiment shown and described. The number and size of the radii used to describe the groove must be adapted to the respective requirements. The groove can also be shaped asymmetrically if the optimum stress distribution requires this. The shoulder can also be embodied in another way. The number of bearing surfaces and the shaping of the shoulder is arbitrary. It is essential that the groove root remains freely formable. If intermediate pieces are used which are arranged between the blade roots, a shoulder is of course also provided on the intermediate pieces.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A bladed rotor of an axial-flow turbomachine which includes blades, the blades comprising a blade body and a blade root, the blades being fastened with their blade roots in rows in encircling blade grooves of the rotor having lateral supporting prongs, wherein a shoulder with bearing surfaces through which the blades are supported on the rotor upon assembly is attached between the blade body and the blade root, the blade grooves being symmetrically shaped to associated planes of symmetry, wherein a groove bottom of the blade grooves of the rotor is shaped by a plurality of circular arcs having different radii, a preceding radius in each case being larger than a following radius, and the circular arcs having a common tangent at a contact point of the circular arcs.

2. The bladed rotor as claimed in claim 1, wherein the bearing surfaces which bear on the rotor are formed by niches that are located in a side of the shoulder facing the rotor.

3. The bladed rotor as claimed in claim 1, wherein shims for fixing the blades are attached between the shoulder and the rotor.

* * * * *